US011488470B2

(12) United States Patent
Eldessouki

(10) Patent No.: US 11,488,470 B2
(45) Date of Patent: Nov. 1, 2022

(54) SYSTEM AND METHOD FOR REAL-TIME ASSESSMENT OF TRAFFIC STREAM FLOW CHARACTERISTICS

(71) Applicant: Imam Abdulrahman Bin Faisal University, Dammam (SA)

(72) Inventor: Wael Mohamad Elsyaed Ali Eldessouki, Dammam (SA)

(73) Assignee: Imam Abdulrahman Bin Faisal University, Dammam (SA)

( * ) Notice: Subject to any disclaimer, the term of this patent is extended or adjusted under 35 U.S.C. 154(b) by 258 days.

(21) Appl. No.: 17/091,021

(22) Filed: Nov. 6, 2020

(65) Prior Publication Data

US 2022/0148416 A1 May 12, 2022

(51) Int. Cl.
*G08G 1/01* (2006.01)
*G08G 1/052* (2006.01)

(52) U.S. Cl.
CPC ..... *G08G 1/0112* (2013.01); *G08G 1/0133* (2013.01); *G08G 1/0141* (2013.01); *G08G 1/0145* (2013.01); *G08G 1/052* (2013.01)

(58) Field of Classification Search
CPC .. G08G 1/0112; G08G 1/0133; G08G 1/0141; G08G 1/0145; G08G 1/052
See application file for complete search history.

(56) References Cited

U.S. PATENT DOCUMENTS

| | | | | |
|---|---|---|---|---|
| 7,706,963 | B2 | 4/2010 | Parikh et al. | |
| 7,877,196 | B2 | 1/2011 | Lin et al. | |
| 9,117,098 | B2 | 8/2015 | Trombley et al. | |
| 9,805,594 | B2 | 10/2017 | Buchholz et al. | |
| 2015/0120174 | A1* | 4/2015 | Lewis | G08G 1/0129 701/118 |

FOREIGN PATENT DOCUMENTS

WO 2018/006997 A1 1/2018

OTHER PUBLICATIONS

Treiber, et al. ; Traffic Flow Dynamics Data, Models, and Simulation ; Springer-Verlag Berlin Heidelberg ; Jun. 2012 ; 504 Pages.

* cited by examiner

*Primary Examiner* — Yuen Wong
(74) *Attorney, Agent, or Firm* — Oblon, McClelland, Maier & Neustadt, L.L.P.

(57) ABSTRACT

The present disclosure relates to a system and method for updating traffic-related infrastructure. The method includes determining average traffic stream speed and average traffic density over a segment of a highway. The method further includes determining, upon analysis of the determined average traffic stream speed and average traffic density over a segment of a highway, an appropriate action in order to update the infrastructure.

20 Claims, 14 Drawing Sheets

Sensor 1RF
Sensor 1RB
t1
t2
t3
t4
X
B
601
605
645
647

Sensor 1LF
Sensor 1LB
LBR
LFR
LBF
LFF
t1
t2
t3
t4
A
X
705
746
744
701

SYSTEM AND METHOD FOR REAL-TIME ASSESSMENT OF TRAFFIC STREAM FLOW CHARACTERISTICS

BACKGROUND

Field of the Disclosure

The present disclosure relates to a method, system and computer program product for evaluating traffic density and average speed of a traffic stream and for determining a state of traffic flow volatility therefrom.

Description of the Related Art

Collecting real-time traffic stream data is one of the most challenging tasks in traffic operations today. Accurate and reliable data of congested traffic areas, for example, may provide decision makers with options in addressing and alleviating traffic burdens but remains difficult to obtain.

To this end, strategies have often employed static sensors to evaluate traffic congestion at a given section of road. For instance, inductive loop detectors, in addition to being limited to providing only volume and spot speed data, are embedded within pavement and generate data only at specific locations. Cameras positioned along a highway, similarly, are bounded by their physical location but can also be limited by their susceptibility to bad weather and visibility. Moreover, installation of either one of these strategies, at scale, would be costly and would require intra- and inter-governmental cooperation. Accordingly, there is a need for a high fidelity method to collect traffic stream attributes that reflect level of service and safety conditions for the traffic flow.

The foregoing "Background" description is for the purpose of generally presenting the context of the disclosure. Work of the inventors, to the extent it is described in this background section, as well as aspects of the description which may not otherwise qualify as prior art at the time of filing, are neither expressly or impliedly admitted as prior art against the present invention.

SUMMARY

The present disclosure relates, generally, to a method of evaluation of traffic conditions and updating infrastructure, responsive thereto, in real-time.

According to an embodiment, the present disclosure relates to a method employed by a server, comprising receiving sensor data from a plurality of sensors of a probe vehicle within a traffic stream, determining, based at least on the received sensor data, an average traffic speed along a current road segment, the average traffic speed determined at least by calculating a speed of neighboring vehicles adjacent to the probe vehicle, determining, based at least on the received sensor data, an average traffic density along the current road segment, the average traffic density determined at least by calculating distances between the neighboring vehicles adjacent passing or taken-over by the probe vehicle as well as between vehicles a head and following the probe vehicle. thereto, and transmitting, based statistical characteristic for the determined average traffic speed and the determined average traffic density to a threshold, an update to infrastructure reflecting traffic flow volatility in order to modify a condition of the traffic stream in real-time.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
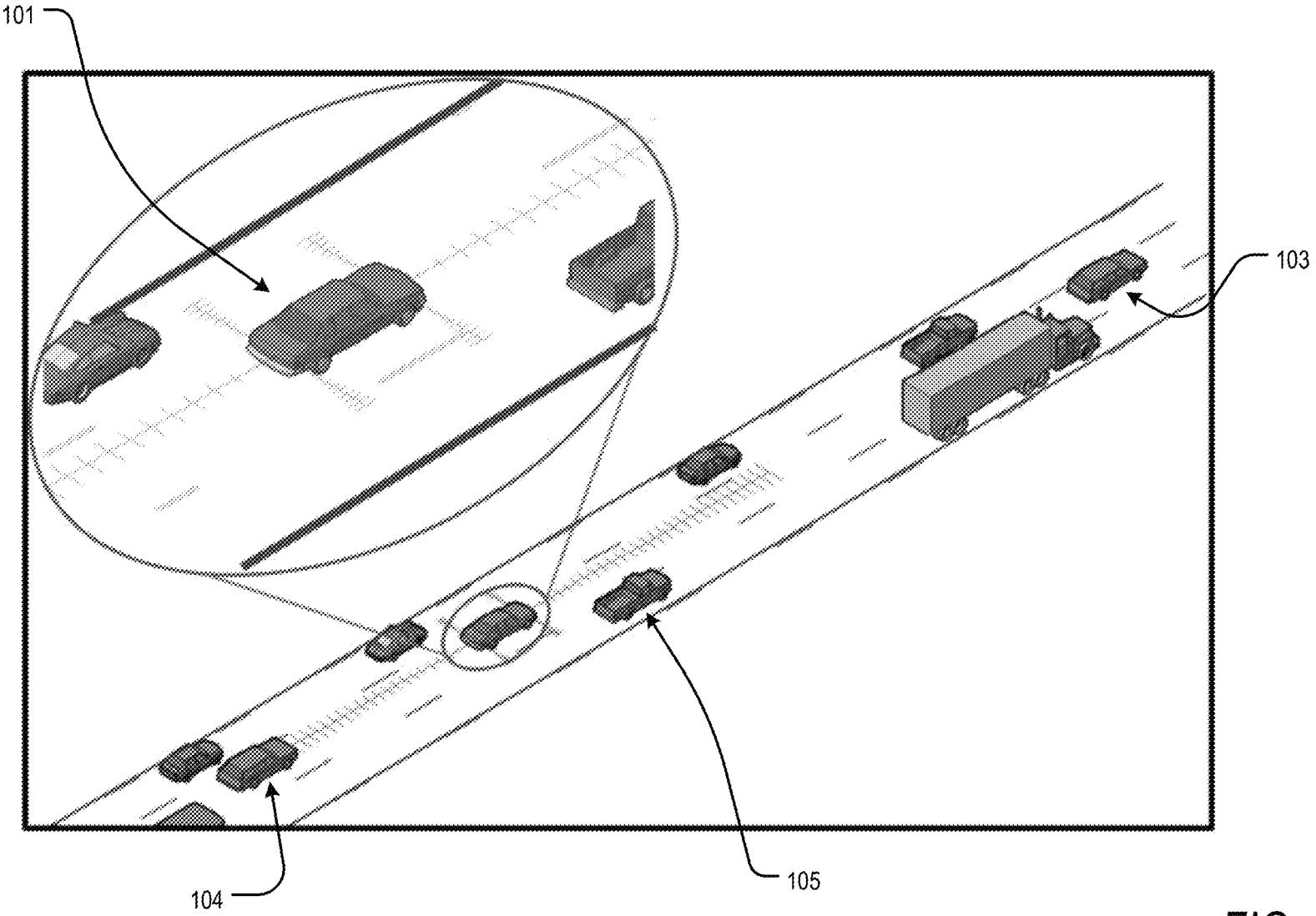
FIG. 1 is an illustration of a floating car, or floating vehicle, in a traffic stream, according to an exemplary embodiment of the present disclosure.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The terms "floating car", "floating vehicle", and 'probe vehicle' may be used interchangeably, when appropriate. Reference throughout this document to "one embodiment", "certain embodiments", "an embodiment", "an implementation", "an example" or similar terms means that a particular feature, structure, or characteristic described in connection with the embodiment is included in at least one embodiment of the present disclosure. Thus, the appearances of such phrases or in various places throughout this specification are not necessarily all referring to the same embodiment. Furthermore, the particular features, structures, or characteristics may be combined in any suitable manner in one or more embodiments without limitation.

In contrast to the traditional, static traffic data collection techniques described above, recent efforts have focused on mobile techniques for collecting traffic data. Floating car data has recently become a focal point of investigations as it is dynamic and provides an economically-feasible pathway to accurate data collection. Unlike traditional, infrastructure-based static traffic data, floating car data provides continuous data collection by using sensors that may be resident on or "attachable to" a vehicle within the traffic stream. For instance, this may be data collected from a mobile device within a vehicle.

Early efforts employed floating car data to measure average speed on highway segments. This was accomplished by instructing a driver to maintain a driving speed such that the number of vehicles passing the 'floating car' was equal to the number of vehicles overtaken by the 'floating car'. Naturally, the resulting data can be variable as the maintained driving speed is approximate and dependent on the ability of a driver to recognize and track the number of vehicles that have passed or been passed.

As a result, researchers have been working to extend the traditional floating car technique to include automated processes. For instance, such extended floating car models automate the process of measuring traffic stream speeds by using cameras attached on both sides of the vehicle to acquire images of neighboring vehicles and then using image processing techniques to estimate the speeds of the neighboring vehicles from the resulting images. This allows for the measurement of traffic data within the stream as the 'floating car' moves with traffic.

The present invention extends the traditional floating car technique beyond the estimation of average traffic speed to an estimation of traffic stream density and an overall estimation for the level of service (LOS) for a segment of a highway. In an embodiment, the system and method allow for determination of traffic density and traffic volatility independent of visibility conditions. According to an embodiment, the present disclosure is directed to an automated and mobile system and method for allowing continuous determination of traffic speed, density, level of service and traffic volatility in a plurality of segments of a highway.

With reference now to the Figures, FIG. 1 is an illustration of an extended floating car in a traffic stream. A floating car, or floating vehicle 101, travels in a middle lane, for instance, of a highway. A leading vehicle 103 and a trailing vehicle 104 travel in front of and behind the floating vehicle 101, respectively, within the middle lane. One or more adjacent vehicles 105 travel in outer lanes of the highway. As opposed to stationary sensors positioned along the highway that determine traffic speed and traffic density over finite stretches of the highway, aspects of the floating car model implemented in the present disclosure allow for the real-time calculation of traffic speed and traffic density relative to a current location of the floating vehicle 101. High fidelity determinations of traffic speed and traffic density require high quality data related to: (1) speed of the floating car, (2) time and location coordinates of the floating car, (3) number of cars passing the floating car, (4) individual speeds for the vehicles passing the floating car, (5) number of vehicles passed by the floating car, (6) individual speeds for the vehicles passed by the floating car, (6) distance between the floating car and the trailing vehicle, and (5) distance between the floating car and the leading vehicle. In acquiring such data, the floating vehicle 101 can be outfitted with a variety of sensors, as introduced briefly with reference to FIG. 2 and as described in greater detail with reference to subsequent Figures.

Figure 2:
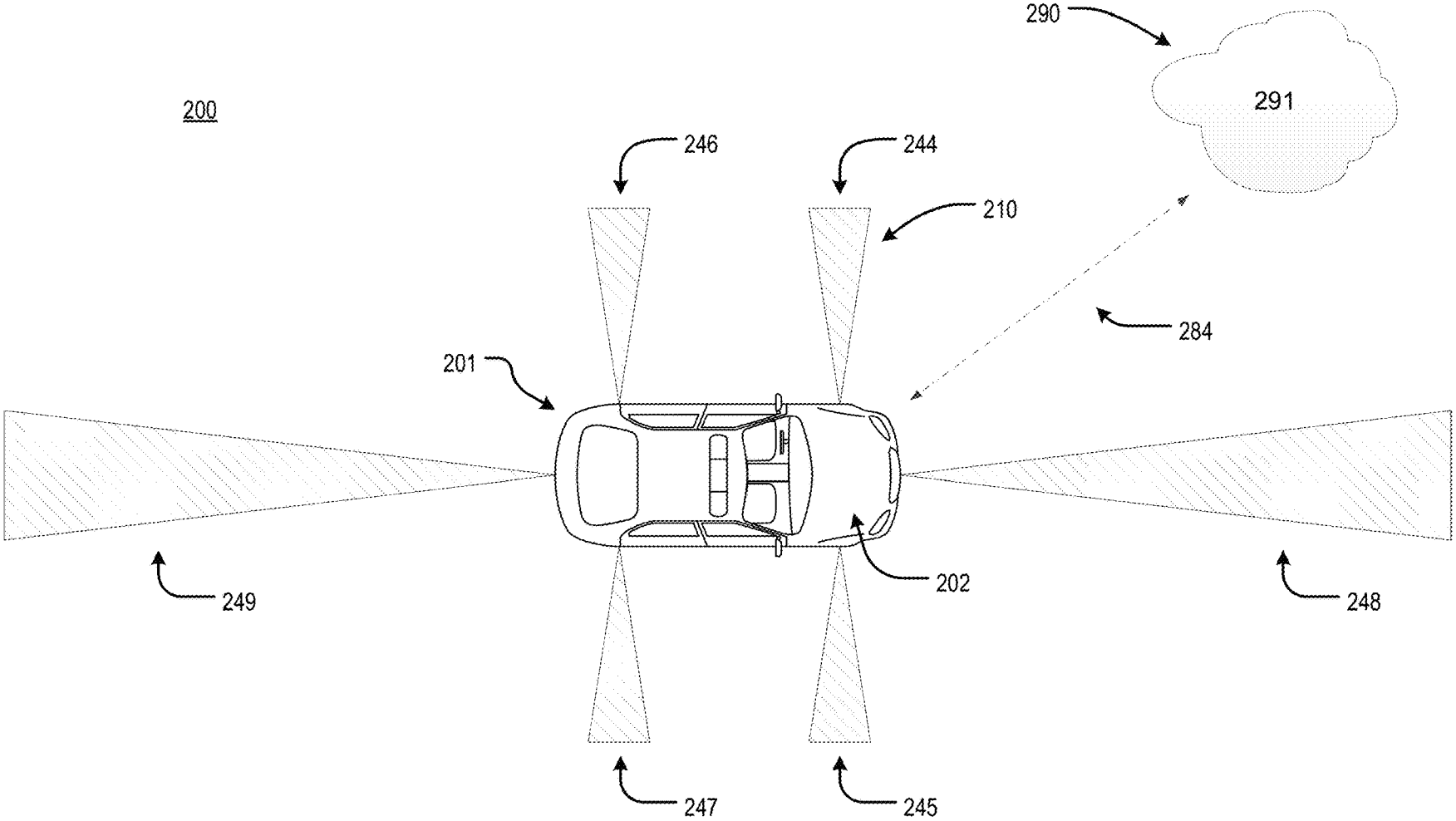
FIG. 2 is a schematic of a subset of sensors of a floating vehicle, according to an exemplary embodiment of the present disclosure.
Figure 4A:
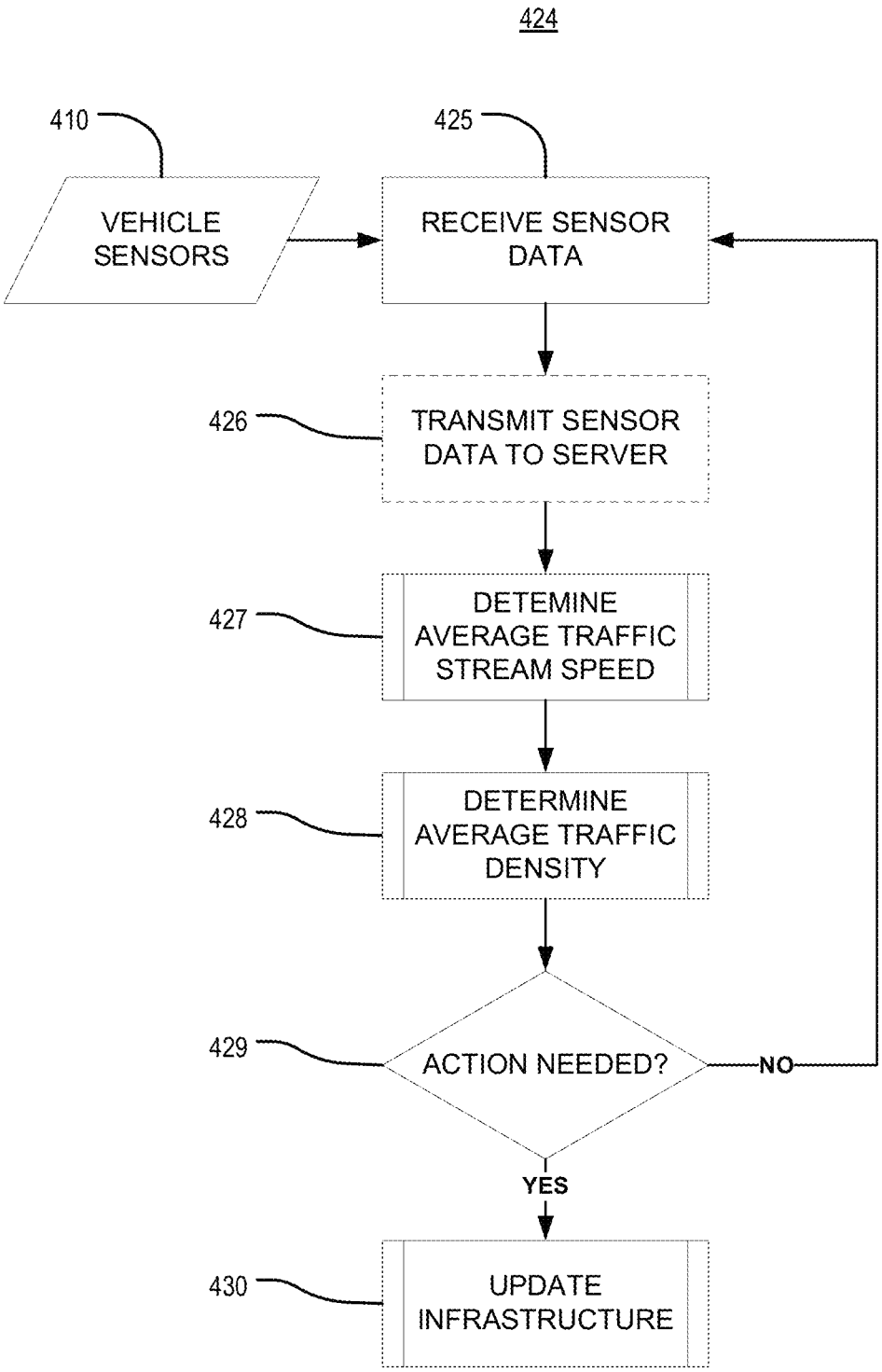
FIG. 4A is a flow diagram of a traffic management system, according an exemplary embodiment of the present disclosure.

According to an embodiment, FIG. 2 is a high-level illustration of a Traffic Monitoring System (TMS) 200. The TMS 200 includes, for example, a floating vehicle 201 comprising a plurality of sensors 210 operatively-connected to an electronics control unit (ECU) 202 resident to the floating vehicle 201. In an embodiment, the ECU 202 of the floating vehicle 201 may perform process 424 of the TMS 200, as described in FIG. 4A. In an embodiment, the ECU 202 of the floating vehicle 201 can communicate with a server 291 of a cloud-computing environment 290 of the TMS 200 via wireless communication link 284. The server 291 may perform process 424 of the TMS 200, as described in FIG. 4A, or may be connected to a traffic management center, wherein aspects of the process of FIG. 4A are performed by either a human user or an Artificially Intelligent System. The plurality of sensors 210 can include vehicle instruments accessible via a vehicle controller area network (CAN) data bus connected to a CAN module. The vehicle instruments can provide, for instance, current vehicle speed and the like. In an embodiment, the plurality of sensors 210 includes a satellite positioning system (SPS) receiver for determining location. The SPS receiver can be a type of Global Navigation Satellite System (GNSS), such as a Global Positioning System (GPS), for real-time determination of current vehicle coordinates. Represented in FIG. 2 by triangular, striped, shaded regions, the plurality of sensors 210 can include presence-type sensors and/or distance-type sensors. In an embodiment, the distance-type sensors can be used to determine the distance between the floating vehicle 201 and a neighboring vehicle (i.e., leading vehicle, trailing vehicle, adjacent vehicle). The presence-type sensors can be used to determine the presence of a neighboring vehicle relative to the floating vehicle 201 (i.e., adjacent vehicle). In an example, the plurality of sensors 210 can be at least six distance-type sensors and/or presence-type sensors. Four distance-type sensors (and/or presence-type sensors) 246, 244, 247, 245 may be mounted along the left side 246, 244 and the right side 247, 245 of the floating vehicle 201. Two distance-type sensors 248, 249 can be mounted at the front end 248 and the rear end 249 of the floating vehicle 201.

During operation, each of the plurality of sensors 210 introduced above can be in electrical communication with the ECU 202 in order to allow for utilization of data received therefrom. The ECU 202 can perform minimal processing on the received data and/or can transmit the sensor data, via the communication link 284, to the server 291 of the cloud-computing environment 290. The server 291 can be further linked to a traffic management center, terminal, computer workstation, a similar user-interactive computing station, or can be configured to execute instructions stored in memory to process the transmitted data, analyze the processed data, and perform actions responsive thereto based upon a set of rules and thresholds. In an example, the actions of the server 291 can be infrastructure-directed actions including, for instance, reducing a speed limit on a certain segment of highway or road, as will be described later with reference to, for instance, FIG. 4D.

Figure 3A:
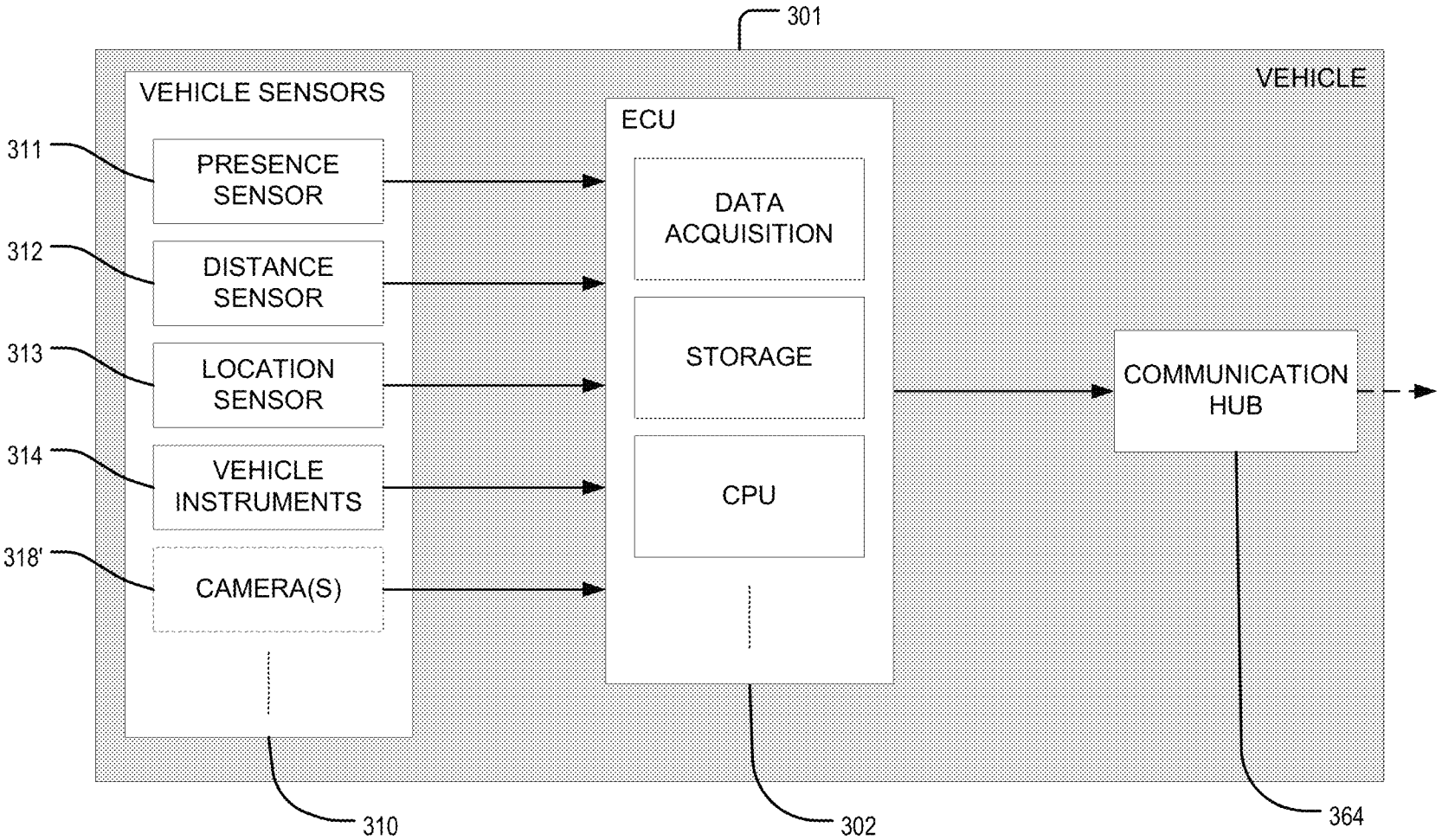
FIG. 3A is a block diagram of components of a floating vehicle, according to an exemplary embodiment of the present disclosure.

FIG. 3A provides a low-level schematic of a floating vehicle 301 of a TMS, according to an embodiment of the present disclosure, including an ECU 302 operatively-connected to a plurality of vehicle sensors 310 and to a communication hub 364. Though, in an example, the floating vehicle 301 is a driver-controlled-vehicle, it can be appreciated that the teachings herein can be applied in the context of autonomous vehicles and/or semi-autonomous vehicles without deviating from the spirit of the invention.

In an embodiment, the plurality of sensors 310 can include a presence sensor(s) 311, a distance sensor(s) 312, a location sensor(s) 313, vehicle instruments 314, a camera(s) 318', and the like. Sensor data from the plurality of sensors 310 can be supplied in parallel to the ECU 302. In an embodiment, the ECU 302 can include at least one of a data acquisition unit, a storage unit, and a central processing unit (CPU). The at least one of the data acquisition unit, the storage unit, and the CPU may regulate, for instance, sensor data communication between the ECU 302 and a server, introduced in FIG. 2. A more detailed hardware implementation of the ECU 302 will be described with reference to FIG. 10.

Data supplied to the ECU 302 from the plurality of sensors 310 can then be processed according to the flow diagram of FIG. 4A. In an embodiment, aspects of this process can be performed by the ECU 302. For example, initial processing of raw sensor data from the plurality of sensors 310 can be performed on-board the floating vehicle 301 within the ECU 302. The initial processing can include a transformation of raw sensor data to refined-sensor data that allows for determinations to be made therefrom (e.g., distance (m), GPS (decimal degrees), speed (km/hr)). Moreover, in an embodiment, step 425, step 427, and step 428 of the flow diagram of FIG. 4A can be performed by the ECU 302, with fully processed data then be transmitted to a server for evaluation and action responsive thereto. In any event, the refined-sensor data can be transmitted to the above-mentioned server via the communication hub 364. In an embodiment, the communication hub 364 can be implemented without limitation via a modem, a network card, an infrared communication device, a wireless communication device, and/or a chipset. Additional description of the communication hub 364 will be described with reference to FIG. 10.

Figure 3B:
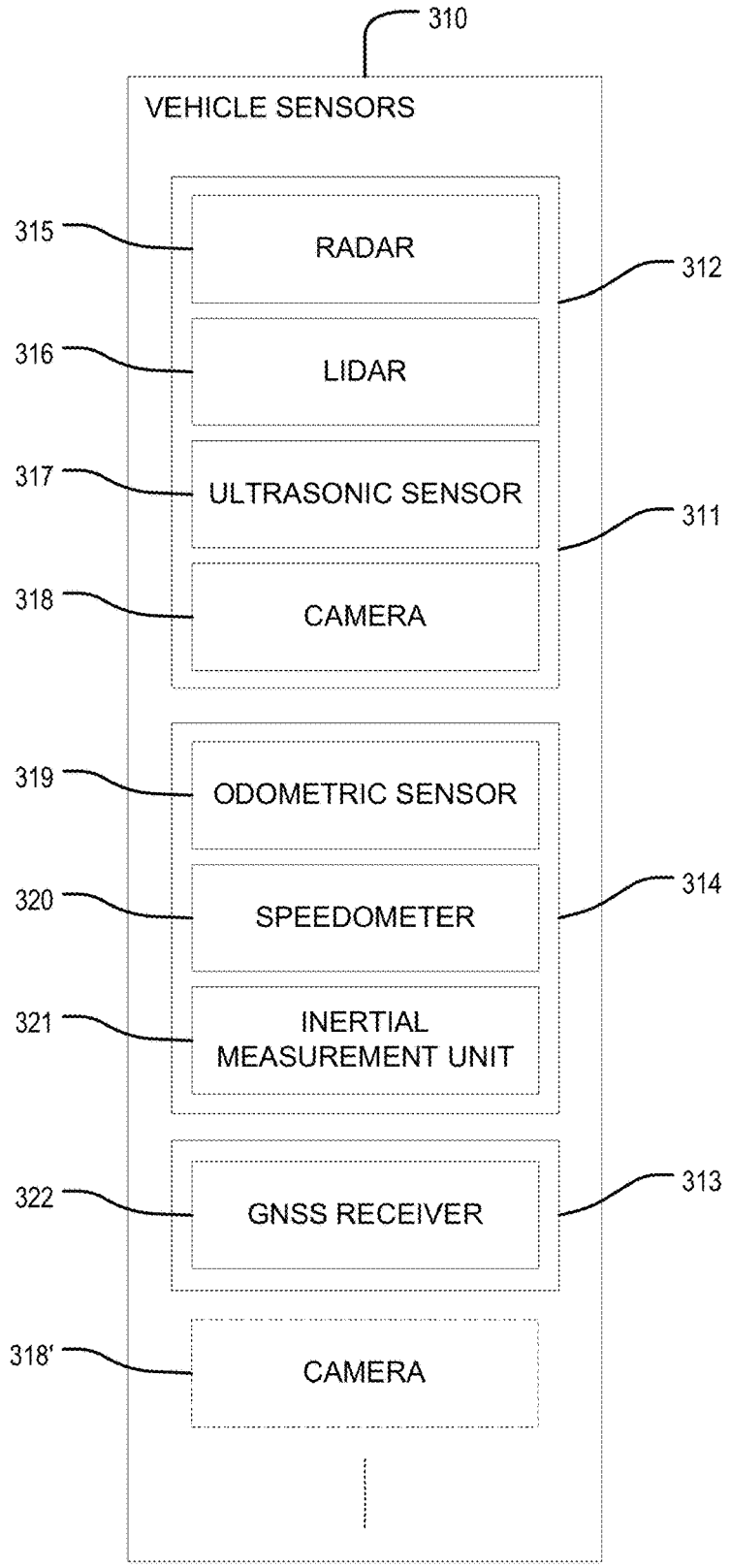
FIG. 3B is a block diagram of sensors of a floating vehicle, according to an exemplary embodiment of the present disclosure.

Introduced above, the plurality of vehicle sensors 310 will now be further described with reference to FIG. 3B.

According to an embodiment, the plurality of sensors 310 can include a distance sensor(s) 312, a presence sensor(s) 311, a location sensor(s) 313, vehicle instruments 314, a camera(s) 318, 318' and the like. In an embodiment, the distance sensor(s) 312 can be a plurality of distance sensors 312 and can include at least one of radar 315, Light Detection and Ranging (lidar) 316, ultrasonic sensor 317, and camera 318, among others. Similarly, the presence sensor(s) 311 can be a plurality of presence sensors 311 and can include at least one of radar 315, lidar 316, ultrasonic sensor 317, and camera 318, among others. In certain embodiments, the presence sensor(s) 311 can be an infrared sensor, a microwave sensor, or similar technology.

In an embodiment, the vehicle instruments 314 can be a plurality of vehicle instruments 314 and can include, among others, at least one of an odometric sensor 319, a speedometer 320, and an inertial measurement unit 321, the inertial measurement unit 321 including at least an accelerometer and a gyroscope.

In an embodiment, the location sensor(s) 313 can be one or more location sensors 313 and can include, as an SPS receiver, a GNSS receiver 322, among others.

In an example, distance sensors 312 may be lidar 316 and may be positioned at the front of the floating vehicle and at the rear of the floating vehicle for determining a distance to a leading vehicle and to a trailing vehicle, respectively. To this end, the lidar 316 may use a technique such as time of flight to determine such distances. It can be appreciated, though, that time of flight is merely a non-limiting example of a variety of approaches to determining distances via lidar, as would be understood by a person of ordinary skill in the art.

In an example, the presence sensors 311 may be radar 315 and may be positioned at the four corners of the floating vehicle, as shown in FIG. 2. The radar 315 may be positioned such that each is directed away from the floating vehicle and along an axis of the axles of the floating vehicle. The orientation of the radar 315 will be better explained with reference to FIG. 5A through FIG. 8. Each presence sensor (s) 311 may deploy radar 315 in order to determine the presence of a vehicle in an adjacent lane. Specifically, the arrangement of the presence sensor(s) 311 allows for detection of an adjacent vehicle as it approaches and then passes the floating car (or floating vehicle). To this end, the radar 315 may use a technique such as time of flight to determine the presence of the adjacent vehicle. The presence of the adjacent vehicle can be determined when a distance between the adjacent vehicle and the floating car, as determined by time of flight, is below a threshold value for an adjacent vehicle. It can be appreciated that time of flight is merely a non-limiting example of a variety of approaches to determining distances via lidar, as would be understood by a person of ordinary skill in the art.

In an example, the vehicle instruments 314 include a speedometer 320. As will be described later, the speedometer 320 provides the current speed of the floating car. When processed by the server, the current speed of the floating car can be used in tandem with sensor data from other of the plurality of sensors 310 to determine speeds of neighboring vehicles.

In an example, the camera 318' can be configured to acquire images of neighboring vehicles. The acquired images can be processed by an image processor of the CPU in order to determine identifiable traits of each vehicle and to track progress (e.g., distance, speed, etc.) of each vehicle along the roadway according to the identifiable traits. Such image processing can include image recognition or similar artificially intelligent approaches.

Now, with an understanding of the hierarchy of the TMS and the plurality of sensors therein, a method of the TMS will be described with reference to FIG. 4A. Process 424 of the TMS includes determining average traffic stream speed, determining average traffic stream density, and updating infrastructure based upon an evaluation of the determined traffic stream speed and determined traffic stream density. It can be appreciated that process 424 may be performed continuously, and in real-time, while a floating vehicle travels a roadway.

At step 425 of process 424, sensor data acquired by the vehicle sensors at step 410 of process 424 are received by the ECU of the floating vehicle. Such sensor data can include presence data, distance data, location data, vehicle instrument data, or a combination thereof. Though, as described herein, only minimal processing of received sensor data is performed by the ECU, it can be appreciated that, in an embodiment, additional processing including determinations of traffic stream speed and traffic stream density may be performed by the ECU prior to transmission to a server.

At step 426 of process 424, the sensor data received by the ECU is transmitted via communications hub to a server. In an embodiment, minimal processing of the sensor data has been performed prior to transmittance of the sensor data to the server.

At sub process 427 of process 424, the server determines average traffic stream speed based upon the transmitted sensor data. The determination, or calculation, of average traffic stream speed will be described in greater detail with reference to FIG. 4B.

At sub process 428 of process 424, the server determines average traffic stream density based upon the transmitted sensor data. The determination, or calculation, of average traffic stream density will be described in greater detail with reference to FIG. 4C.

At step 429 of process 424, the server determines whether an action is needed. In particular, the server can perform a gross comparison of a magnitude of either one the average traffic stream speed and the average traffic stream density to a threshold.

Alternatively, the gross comparison may comprise evaluating a relationship between the average traffic stream speed and the average traffic stream density. In an embodiment, the gross comparison may be an evaluation of a relationship between statistical characteristics of both the average traffic stream speed and the average traffic stream density, the relationship therebetween defining a metric of 'volatility' that can be compared to a safety threshold. For instance, if it is determined that a highway is 'volatile', an infrastructure update may be performed at sub process 430 of process 424. In an embodiment, the gross comparison may be an evaluation of predictive variables that are known to be indicative of future traffic concerns. For instance, if a metric is defined by traffic density normalized to traffic speed, a trend of an increasing magnitude of the metric over a one hour period, even if not above a crude threshold, may be justification for consideration of a preemptive infrastructure update, as it may be indicative of future volatility. Such comparison of the metric may comprise an evaluation of a rate of change of the metric over time relative to a threshold.

The decision point of step 429 of process 424 is intended to triage processed data such that, in real-time, a refined approach to an infrastructure update may be made at sub process 430 or process 424 may begin anew at step 425. When performed at scale and/or with a fleet of floating vehicles, connected or otherwise, this approach allows resources to be dedicated where most necessary.

If the processed data is determined appropriate for further evaluation, analysis, and action, an infrastructure update can be initiated at sub process 430 of process 424. The infrastructure update can include, generally, infrastructure changes that may influence current traffic flow conditions and reduce volatility. As will be described in greater detail with reference to FIG. 4D, these changes can be adjustments to traffic signals, dispatching of local law enforcement, temporal reductions in speed limit, and the like.

Figure 4B:
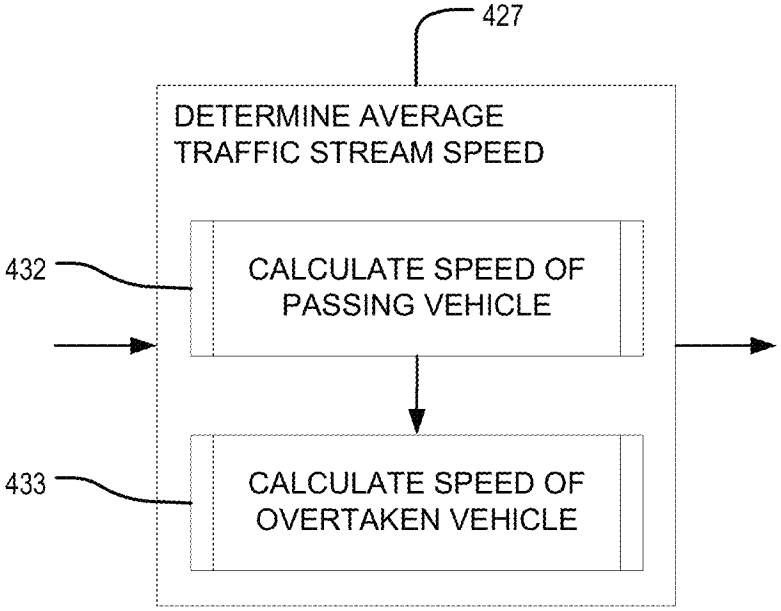
FIG. 4B is a flow diagram of a process of determining average traffic stream speed, according an exemplary embodiment of the present disclosure.

With reference to FIG. 4B, sub process 427 of process 424 determines an average traffic stream speed. Generally, the average traffic stream speed can be expressed as the average sum of observed speeds over a segment of highway. This expression can be considered equivalent to the space mean speed (SMS). In view of the extended floating car model presented herein, the SMS, or average of the observed speeds, can be defined as $$SMS = \frac{\sum_{i=1}^{n} V_i}{n} \tag{1}$$

where SMS is the space mean speed (km/hr) for a road segment, Vi is the observed speed (km/hr) for vehicle i, and n is the number of observations on the road segment.

The SMS presented in Equation (1), however, fails to describe how the observed speed for vehicle i is to be determined. In order to determine observed speeds (i.e., estimate the speed of neighboring vehicles), sub process 432 and sub process 433 of sub process 427 are performed to calculate the speed of passing vehicles and overtaken vehicles, respectively.

In an embodiment, and with reference to FIG. 5A through FIG. 5D, sub process 432 of sub process 427 can be performed to calculate the speed of a passing vehicle. To this end, the plurality of sensors of a floating vehicle 501 ('X') is represented by triangular shapes with hashed lines, a silhouette similar to that of FIG. 2. FIG. 5A through FIG. 5D depict an adjacent vehicle 505 (A') passing the floating vehicle 501 on the left. As the adjacent vehicle 505 passes by the side of the floating vehicle 501, the adjacent vehicle 505 comes into the path of a presence sensor of the plurality of sensors of the floating vehicle 501. As an example, the presence sensor of the plurality of sensors of the floating vehicle 501 may be radar. Each Figure of FIG. 5A through FIG. 5D reflects a time stamp at which a signal from one of the plurality of sensors of the floating vehicle 501 is activated or deactivated. In other words, FIG. 5A through FIG. 5D depict phases of the adjacent vehicle 505 passing the floating vehicle 501, or floating car, each phase being related to a time stamp associated with changes to signals output from each of the plurality of sensors along the side of the floating vehicle 501.

Figures 5A, 5B, 5C, 5D:
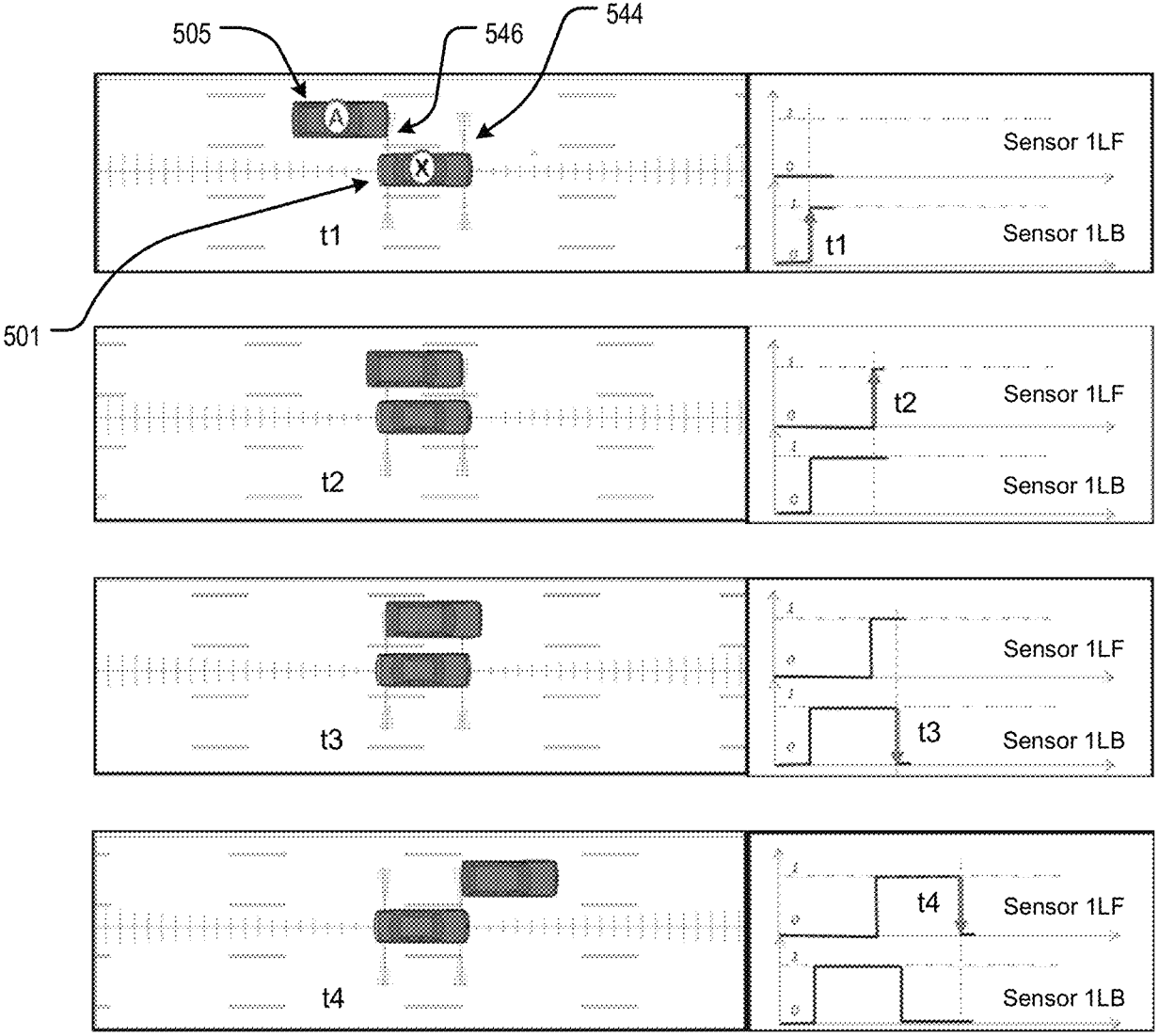
FIG. 5A is an illustration of an aspect of determining average traffic stream speed, according an exemplary embodiment of the present disclosure.
FIG. 5B is an illustration of an aspect of determining average traffic stream speed, according an exemplary embodiment of the present disclosure.
FIG. 5C is an illustration of an aspect of determining average traffic stream speed, according an exemplary embodiment of the present disclosure.
FIG. 5D is an illustration of an aspect of determining average traffic stream speed, according an exemplary embodiment of the present disclosure.

For instance, at time stamp 't1', 'Sensor 1LB' 546 (i.e., a sensor on the left side and in the rear of the floating vehicle 501) changes binary state from 0 to 1. This is reflected in the graphical representation on the right hand side of FIG. 5A. In other words, 'Sensor 1LB' 546 detects the presence of the adjacent vehicle 505. At time stamp 't2', shown in FIG. 5B, 'Sensor 1LF' 544 (i.e., a sensor on the left side and in the front of the floating vehicle 501) changes binary state from 0 to 1. In other words, 'Sensor 1LF' 544 detects the presence of the adjacent vehicle 505. As the adjacent vehicle 505 passes by the floating vehicle 501 on the left side, the plurality of sensors on the left side of the car begin to change state. At time stamp 't3', shown in FIG. 5C, when the adjacent vehicle 505 clears from the detection area of 'Sensor 1LB' 546, 'Sensor 1LB' 546 changes binary state from 1 to 0. Similarly, as the adjacent vehicle 505 clears from the detection area of the floating vehicle 501 at time stamp 't4', 'Sensor 1LF' 544 changes binary state from 1 to 0, as shown in FIG. 5D.

The speed of the adjacent vehicle 505 as it passes the floating vehicle 501 can then be estimated as $$V_A = V_X + \frac{2d}{(t2 - t1) + (t4 - t3)}$$

where $V_A$ is the speed of the passing, adjacent vehicle, $V_X$ is the speed of the floating vehicle, as can be determined from the vehicle instruments of the plurality of instruments of the floating vehicle, d is the distance between 'Sensor 1LF' and 'Sensor 1LB', t1 is the signal rising edge for 'Sensor 1LB', t2 is the signal rising edge for 'Sensor 1LF', t3 is the signal falling edge for 'Sensor 1LB', and t4 is the signal falling edge for 'Sensor 1LF'.

Considered in metric units, the speed of the adjacent vehicle 505 as it passes the floating vehicle 501 can then be estimated as $$V_A = V_X + \frac{2d * 3.6}{(t2 - t1) + (t4 - t3)} \quad (2)$$

where $V_A$ is the speed (km/hr) of the passing, adjacent vehicle, $V_X$ is the speed (km/hr) of the floating vehicle, as can be determined from the vehicle instruments of the plurality of instruments of the floating vehicle, d is the distance (m) between 'Sensor 1LF' and 'Sensor 1LB', t1 is the signal rising edge for 'Sensor 1LB', t2 is the signal rising edge for 'Sensor 1LF', t3 is the signal falling edge for 'Sensor 1LB', and t4 is the signal falling edge for 'Sensor 1LF'.

Having calculated the speed of a passing, adjacent vehicle, it is also necessary to calculate the speed of an overtaken, adjacent vehicle. To this end, sub process 433 will be described with reference to FIG. 6A through FIG. 6D, In an embodiment, and with reference to FIG. 6A through FIG. 6D, sub process 433 of sub process 427 can be performed to calculate the speed of an overtaken vehicle. To this end, the plurality of sensors of a floating vehicle 601 ('X') is represented by triangular shapes with hashed lines, a silhouette similar to that of FIG. 2. FIG. 6A through FIG. 6D depict an adjacent vehicle 605 (A') being overtaken by the floating vehicle 601 on the left. As the adjacent vehicle 605 is overtaken, the adjacent vehicle 605 comes into the path of a presence sensor of the plurality of sensors along the right side of the floating vehicle 601. As an example, the presence sensor of the plurality of sensors of the floating vehicle 601 may be radar. Each Figure of FIG. 6A through FIG. 6D reflects a time stamp at which a signal from one of the plurality of sensors of the floating vehicle 601 is activated or deactivated. In other words, FIG. 6A through FIG. 6D depict phases of the adjacent vehicle 605 as it is overtaken by the floating vehicle 601, or floating car, each phase being related to a time stamp associated with changes to signals output from each of the plurality of sensors along the side of the floating vehicle 601.

Figures 6A, 6B, 6C, 6D:
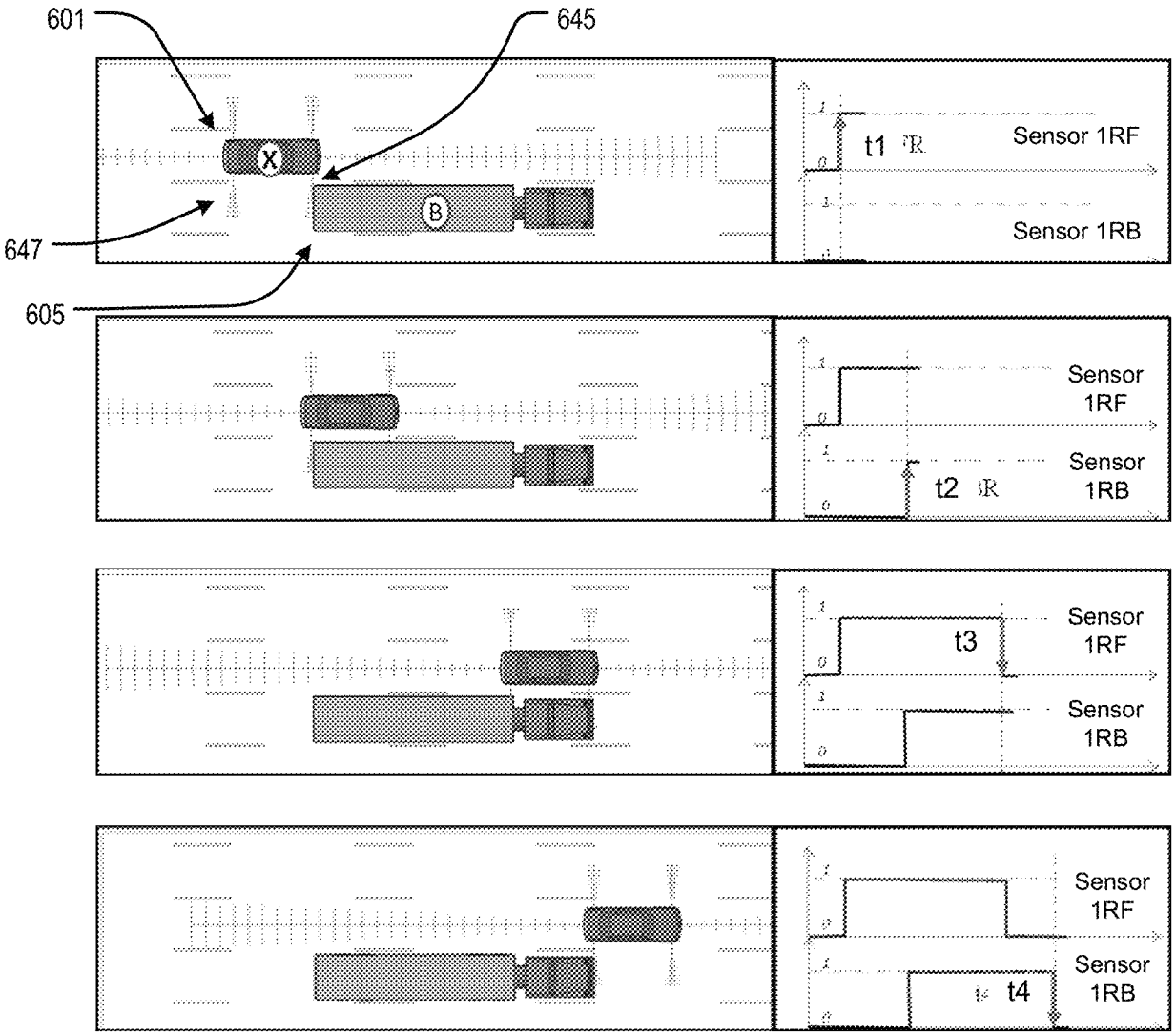
FIG. 6A is an illustration of an aspect of determining average traffic stream speed, according an exemplary embodiment of the present disclosure.
FIG. 6B is an illustration of an aspect of determining average traffic stream speed, according an exemplary embodiment of the present disclosure.
FIG. 6C is an illustration of an aspect of determining average traffic stream speed, according an exemplary embodiment of the present disclosure.
FIG. 6D is an illustration of an aspect of determining average traffic stream speed, according to an exemplary embodiment of the present disclosure.
Figures 7A, 7B, 7C, 7D:
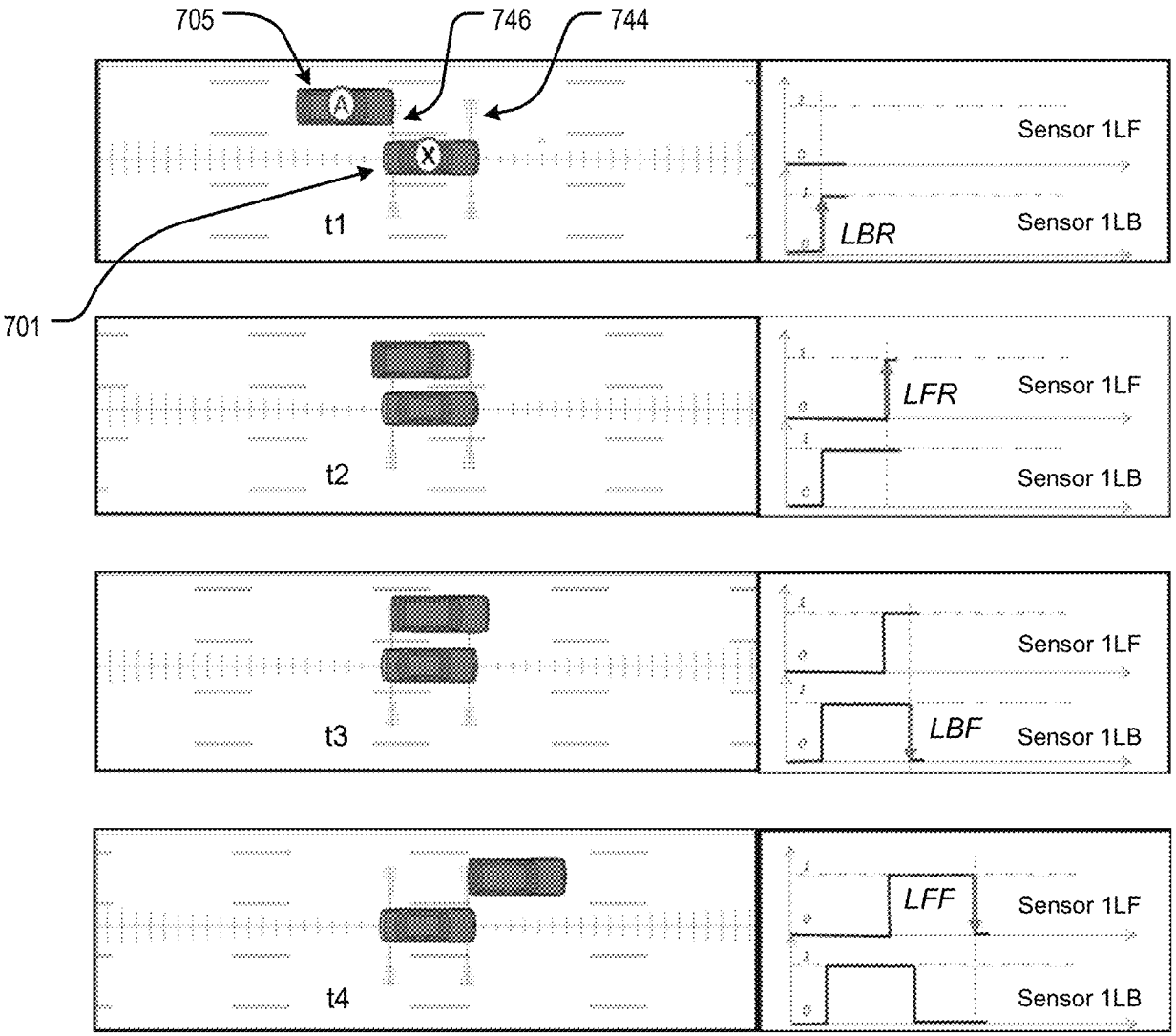
FIG. 7A is an illustration of an aspect of determining average traffic stream speed, according to an exemplary embodiment of the present disclosure.
FIG. 7B is an illustration of an aspect of determining average traffic stream speed, according to an exemplary embodiment of the present disclosure.
FIG. 7C is an illustration of an aspect of determining average traffic stream speed, according to an exemplary embodiment of the present disclosure.
FIG. 7D is an illustration of an aspect of determining average traffic stream speed, according to an exemplary embodiment of the present disclosure.

For instance, at time stamp 't1', 'Sensor 1RF' 645 (i.e., a sensor on the right side and in the front of the floating vehicle 601) changes binary state from 0 to 1. This is reflected in the graphical representation on the right hand side of FIG. 6A. In other words, 'Sensor 1RF' 645 detects the presence of the adjacent vehicle 605. At time stamp 't2', shown in FIG. 6B, 'Sensor 1RB' 647 (i.e., a sensor on the right side and in the rear of the floating vehicle 601) changes binary state from 0 to 1. In other words, 'Sensor 1RB' 647 detects the presence of the adjacent vehicle 605. As the floating vehicle 601 passes by the adjacent vehicle 605 on the left side, the plurality of sensors on the right side of the floating vehicle 601 begin to change state. At time stamp 't3', shown in FIG. 6C, when the adjacent vehicle 605 clears from the detection area of 'Sensor 1RF' 645, 'Sensor 1RF' 645 changes binary state from 1 to 0. Similarly, as the adjacent vehicle 605 clears from the detection area of the floating vehicle 601 at time stamp 't4', 'Sensor 1RB' 647 changes binary state from 1 to 0, as shown in FIG. 6D.

The speed of the adjacent vehicle 605 as it is overtaken by the floating vehicle 601 can then be estimated as $$V_A = V_X - \frac{2d}{(t2 - t1) + (t4 - t3)}$$

where $V_A$ is the speed of the overtaken, adjacent vehicle, $V_X$ is the speed of the floating vehicle, as can be determined from the vehicle instruments of the plurality of instruments of the floating vehicle, d is the distance between 'Sensor 1RF' and 'Sensor 1RB', t1 is the signal rising edge for 'Sensor 1RF', t2 is the signal rising edge for 'Sensor 1RB', t3 is the signal falling edge for 'Sensor 1RF', and t4 is the signal falling edge for 'Sensor 1RB'.

Considered in metric units, the speed of the adjacent vehicle 605 as it is overtaken by the floating vehicle 601 can then be estimated as $$V_A = V_X - \frac{2d * 3.6}{(t2 - t1) + (t4 - t3)} \quad (3)$$

where $V_A$ is the speed (km/hr) of the overtaken, adjacent vehicle, $V_X$ is the speed (km/hr) of the floating vehicle, as can be determined from the vehicle instruments of the plurality of instruments of the floating vehicle, d is the distance (m) between 'Sensor 1RF' and 'Sensor 1RB', t1 is the signal rising edge for 'Sensor 1RF', t2 is the signal rising edge for 'Sensor 1RB', t3 is the signal falling edge for 'Sensor 1RF', and t4 is the signal falling edge for 'Sensor 1RB'.

While the above descriptions of FIG. 5A through FIG. 6D provide expressions for the speed of adjacent vehicles, the expressions rely on the time-domain to relate the expression. Accordingly, FIG. 7A through FIG. 7D provide a general equation for estimating speed of adjacent vehicles, wherein the time-domain notation can be changed to sensor signal change of state notation. In other words, t1 may be replaced by rising (i.e., from low to high) and t3 may be replaced by falling (i.e., from high to low). These can be expressed in FIG. 7A through FIG. 7D as a floating vehicle 701 is passed on the left by an adjacent vehicle 705, the adjacent vehicle entering and leaving the detection area of 'Sensor 1LB' 746 and 'Sensor 1LF' 744 as it passes. At each phase, a rising signal of 'Sensor 1LB' can be denoted by LBR, a rising signal of 'Sensor 1LF' can be denoted by LFR, a falling signal of 'Sensor 1LB' can be denoted by LBF, and a falling signal of 'Sensor 1LF' can be denoted by LFF.

Accordingly, the speed of the adjacent vehicle 705 as it passes the floating vehicle 701 can then be estimated as $$V_A = V_X + \frac{2d}{(LFR - LBR) + (LFF - LBF)}$$

where $V_A$ is the speed of the passing, adjacent vehicle, $V_X$ is the speed of the floating vehicle, as can be determined from the vehicle instruments of the plurality of instruments of the floating vehicle, d is the distance between 'Sensor 1LB' and 'Sensor 1LF', LFR is the rising time for 'Sensor 1LF', LFF is the falling time for 'Sensor 1LF', LBR is the rising time for 'Sensor 1LB', and LBF is the falling time for 'Sensor 1LB'.

Considered in metric units, the speed of the adjacent vehicle 705 as it passes the floating vehicle 701 can then be estimated as $$V_A = V_X + \frac{2d * 3.6}{(LFR - LBR) + (LFF - LBF)} \tag{4}$$

where $V_A$ is the speed (km/hr) of the passing, adjacent vehicle, $V_X$ is the speed (km/hr) of the floating vehicle, as can be determined from the vehicle instruments of the plurality of instruments of the floating vehicle, d is the distance (m) between 'Sensor 1LB' and 'Sensor 1LF', LFR is the rising time (s) for 'Sensor 1LF', LFF is the falling time (s) for 'Sensor 1LF', LBR is the rising time (s) for 'Sensor 1LB', and LBF is the falling time (s) for 'Sensor 1LB'.

Similar calculations can be made, in view of the above, to provide a generalization of the speed of the adjacent vehicle as it is being overtaken by the floating vehicle.

A generalized form of (4) can be written as $$V_A = V_X + \frac{2d * 3.6}{(FR - BR) + (FF - BF)}$$

where FR, BR, FF, and BF define falling times (i.e., FF, BF) and rising times (i.e., FR, BR) of sensors arranged along a respective side of the vehicle.

Figure 4C:
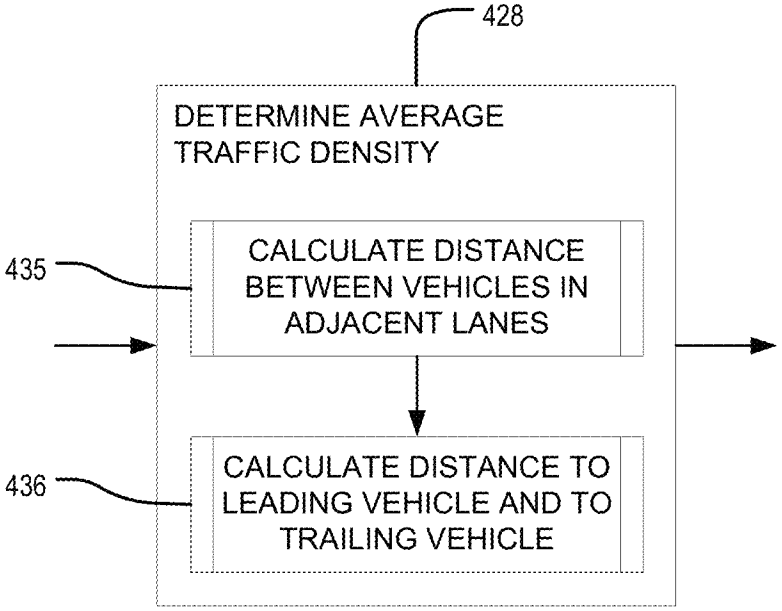
FIG. 4C is a flow diagram of a process of determining average traffic stream density, according an exemplary embodiment of the present disclosure.

Having determined average traffic stream speed at sub process 427 of process 424, the average traffic stream density may be determined at sub process 428 of process 424. With reference to FIG. 4C, average traffic stream density can be determined by calculating a distance between vehicles in adjacent lanes at sub process 435 of sub process 428 and by calculating a distance, from the floating vehicle, to a leading vehicle and a trailing vehicle at sub process 436 of sub process 428.

Figure 8:
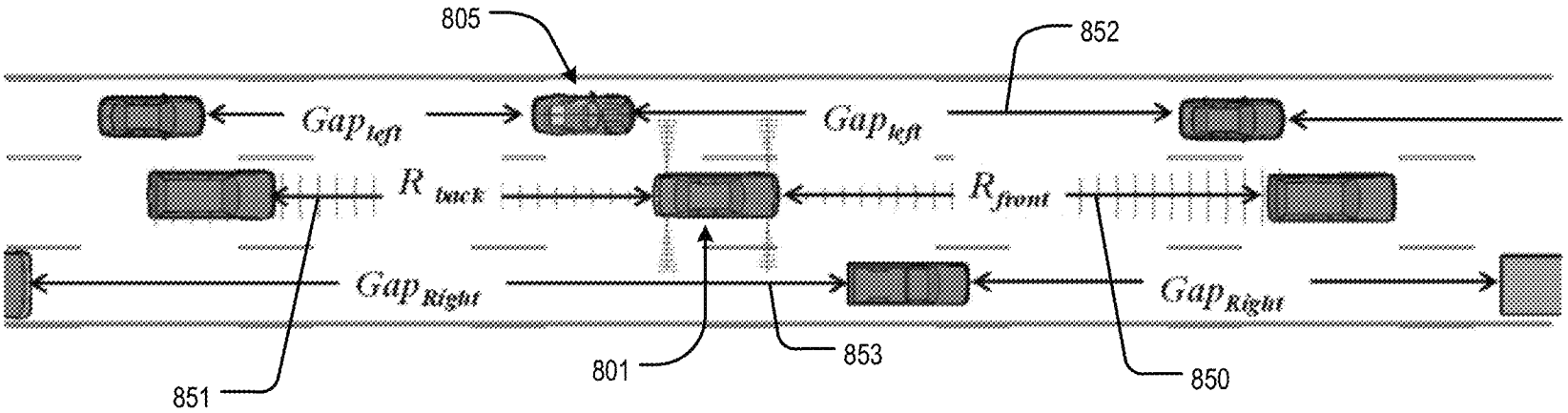
FIG. 8 is an illustration of determined distances between adjacent vehicles of a floating vehicle, according to an exemplary embodiment of the present disclosure.

In other words, and with reference to FIG. 8, the average traffic stream density can be estimated based on two components that reflect maneuverability of a floating vehicle 801. First, the average observed spacing between the vehicles in both lanes and on both sides of the floating vehicle 801 must be calculated. Second, the average spacing between the floating vehicle 801 and a leading vehicle and a trailing vehicle must be determined.

Distances between adjacent vehicles 805 on both sides of the floating vehicle 801, or gaps 852, 853, can be estimated using similar notations as those described above with reference to FIG. 5A through FIG. 7D. To this end, the average time gap between two successive adjacent vehicles 805 passing the floating vehicle 801 can be multiplied by the average speed of the adjacent vehicles 805 relative to the floating vehicle 801. This can be expressed as $$Gap_n = \text{Avg. Time Gap}(n\&n+1) * [\text{Avg. Relative Speed}]$$

Substituting (4), this expression can be written as $$Gap_n = \frac{(LFR_{n+1} - LFR_n) + (LBR_{n+1} - LBR_n)}{2} * \left[\frac{(V_n + V_{n+1})}{2} - V_X\right]$$

where $Gap_n$ is the distance between successive, adjacent vehicles of an adjacent lane, $V_n$ and $V_{n+1}$ are the speeds of successive, adjacent vehicles passing the floating vehicle, $V_X$ is the speed of the floating vehicle, $LFR_n$ and $LFR_{n+1}$ are signal rise times for 'Sensor 1LF' on each of the successive, adjacent vehicles passing the floating vehicle, and $LBR_n$ and $LBR_{n+1}$ are signal rise times for 'Sensor 1LB' on each of the successive, adjacent vehicles passing the floating vehicle.

Considered in metric units, the expression can be written as $$Gap_n = \frac{(LFR_{n+1} - LFR_n) + (LBR_{n+1} - LBR_n)}{2} * \left[\frac{\frac{(v_n + v_{n+1})}{2} V_X}{3.6}\right] \tag{5}$$

where $Gap_n$ is the distance (m) between successive, adjacent vehicles of an adjacent lane, $V_n$ and $V_{n+1}$ are the speeds (km/hr) of successive, adjacent vehicles passing the floating vehicle, $V_X$ is the speed (km/hr) of the floating vehicle, $LFR_n$ and $LFR_{n+1}$ are signal rise times (s) for 'Sensor 1LF' on each of the successive, adjacent vehicles passing the floating vehicle, and $LBR_n$ and $LBR_{n+1}$ are signal rise times (s) for 'Sensor 1LB' on each of the successive, adjacent vehicles passing the floating vehicle.

A generalized form of (5) can be written as $$Gap_n = \frac{(FR_{n+1} - FR_n) + (BR_{n+1} - BR_n)}{2} * \left[\frac{\frac{(V_n + V_{n+1})}{2} - V_X}{3.6}\right]$$

where $FR_n$, $FR_{n+1}$, $BR_n$, and $BR_{n+1}$ define rising times of sensors arranged along a respective side of the vehicle, the rising times being acquired for each of successive adjacent vehicles.

In view of the successive, adjacent cars described above, the average traffic stream density can be sampled and averaged over a meaningful segment of the highway, the results thereof being used to estimate the average traffic stream density as $$D_{avg} = \frac{1}{3}\left\{\frac{1}{\overline{Gap}_{Left}} + \frac{2}{\overline{R}_{Front} + \overline{R}_{Back}} + \frac{1}{+\overline{Gap}_{Right}}\right\}$$

where $D_{avg}$ is the average traffic stream density of a segment of the highway, $\overline{Gap}_{Left}$ 852 is the average observed gaps between successive, adjacent vehicles passing the floating vehicle 801 on the left side, $\overline{Gap}_{Right}$ 853 is the average observed gaps between successive, adjacent vehicles passing the floating vehicle 801 on the right side, $\overline{R}_{Back}$ 851 is the average distance between the trailing vehicle and the floating vehicle 801, and $\overline{R}_{Front}$ 850 is the average distance between the leading vehicle and the floating vehicle 801.

Considered in metric units, the average traffic stream density can be estimated as $$D_{avg} = \frac{1}{3}\left\{\frac{1000}{\overline{Gap}_{Left}} + \frac{2000}{\overline{R}_{Front} + \overline{R}_{Back}} + \frac{1000}{+\overline{Gap}_{Right}}\right\} \quad (6)$$

where $D_{avg}$ is the average traffic stream density of a segment of the highway (veh/km/ln), $\overline{Gap}_{Left}$ 852 is the average observed gaps (m) between successive, adjacent vehicles passing the floating vehicle 801 on the left side, $\overline{Gap}_{Right}$ 853 is the average observed gaps (m) between successive, adjacent vehicles passing the floating vehicle 801 on the right side, $\overline{R}_{Back}$ 851 is the average distance (m) between the trailing vehicle and the floating vehicle 801, and $\overline{R}_{Front}$ 850 is the average distance (m) between the leading vehicle and the floating vehicle 801.

Having determined the average traffic stream speed and the average traffic stream density, as described in FIG. 4B and FIG. 4C, and assuming an action is determined necessary at step 429 of process 424, the determined metrics can be further processed by the server of the cloud-computing environment and/or can be transmitted to a traffic management center for action by a human user.

Figure 4D:
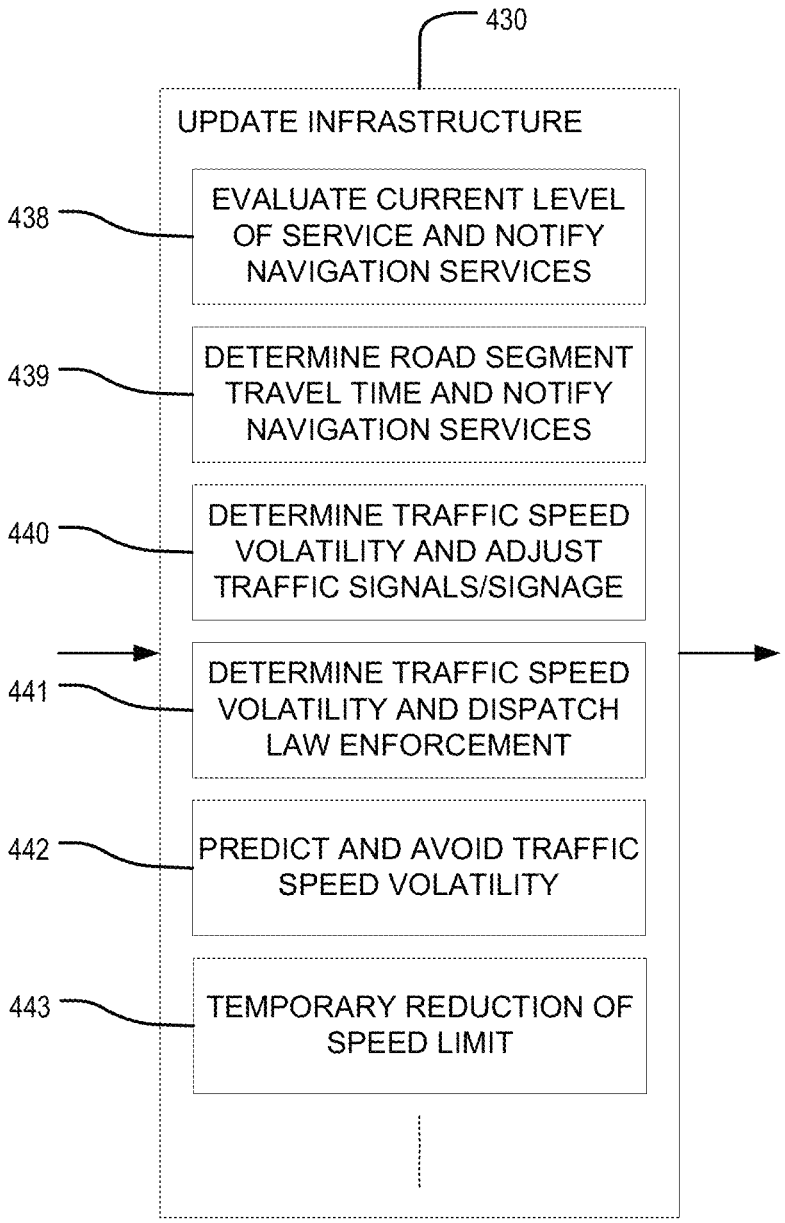
FIG. 4D is a flow diagram of a process of updating infrastructure, according an exemplary embodiment of the present disclosure.

FIG. 4D describes actions that can be performed, either by the server or by a human user at a terminal, in order to update infrastructure. Thus, sub process 430 of process 424 describes infrastructure updates, according to an embodiment of the invention.

In an example, the infrastructure can be updated at sub process 430 by evaluating current level of service and notifying navigation services 438. Level of service can be determined based on traffic density and by utilizing the Highway Capacity Manual (HCM) methods for estimating the level of service. For instance, the level of service can be determined to be A, B, C, D, E, or F according to estimated distances between vehicles in the traffic stream, wherein an A level of service indicates adequate space between neighboring vehicles and an F level of service indicates severe congestion and minimal space between vehicles. The level of service can be estimated by the server and automatically transmitted, in real-time, to other traffic stream users via mobile applications. For instance, the level of service can be disseminated in real-time to navigation software applications (e.g., Google, Waze, Apple Maps) or ride-sharing software applications (e.g., Lyft, Uber, Juno).

In an example, and similar to the above, the infrastructure can be updated at sub process 430 by determining road segment travel time and notifying navigation services 439 such that optimal routes can be planned with real-time traffic updates.

In an example, the infrastructure can be updated at sub process 430 by determining traffic speed volatility and adjusting speed limits, traffic signals, and/or signage 440 responsive thereto. As discussed above, traffic volatility is defined by a relationship between statistical characteristics of traffic stream density and traffic stream speed. The relationship is known to be inversely proportional. If drivers fail to slow down in a congested area, then the traffic stream becomes susceptible to accidents and chances of chain accidents increase quickly. In the example, when the traffic stream is determined to be volatile, the server may automatically generate instructions to modify traffic signals at various locations along a route. In addition, or in another example, the server may automatically generate instructions to control variable message signs such that highway speed limits can be updated in accordance with known congestion.

In an example, and similar to the above, the infrastructure can be updated at sub process 430 by determining traffic speed volatility and dispatching law enforcement 441. The law enforcement may be dispatched in order to provide a presence in a congested area, thereby causing drivers to be more mindful and, therefore, slowing the traffic stream speed. The law enforcement may also be dispatched with portable signs in order to convey traffic-related messages to drivers.

It can be appreciated that, in addition to the above infrastructure updates that can occur in response to evaluations of current conditions and determinations of actively-occurring traffic congestion and the like, the present disclosure also describes a method for pre-emptively updating the infrastructure in anticipation of future traffic events. To this end, and in an example, the infrastructure can be updated at sub process 430 in response to a prediction of traffic speed volatility 442. In an example, a floating vehicle is evaluated for traffic volatility over a period of 30 minutes of driving. As the floating vehicle proceeds at a constant speed, the traffic density of the traffic stream increases, leading to increased traffic volatility, as defined above. With knowledge of other floating vehicles of a fleet of floating vehicles, or following an analysis of the increased traffic volatility, the server may automatically generate an instruction to update the infrastructure in anticipation of an event. For instance, the analysis of the increased traffic volatility may indicate that the rate of increase of traffic stream density relative to traffic stream speed, controlling for a time of day and day of week, is 2× higher than expected. Accordingly, the server can generate, in real-time, an instruction to adjust speed limits of variable message signs such that the speed limit along a stretch of road is reduced by 10 mph. In an example, this can be a temporary reduction of a speed limit 443 on the stretch of road.

It can be appreciated that similar, predictive actions to update infrastructure can be imagined and enacted without deviating from the spirit of the invention.

Figure 9:
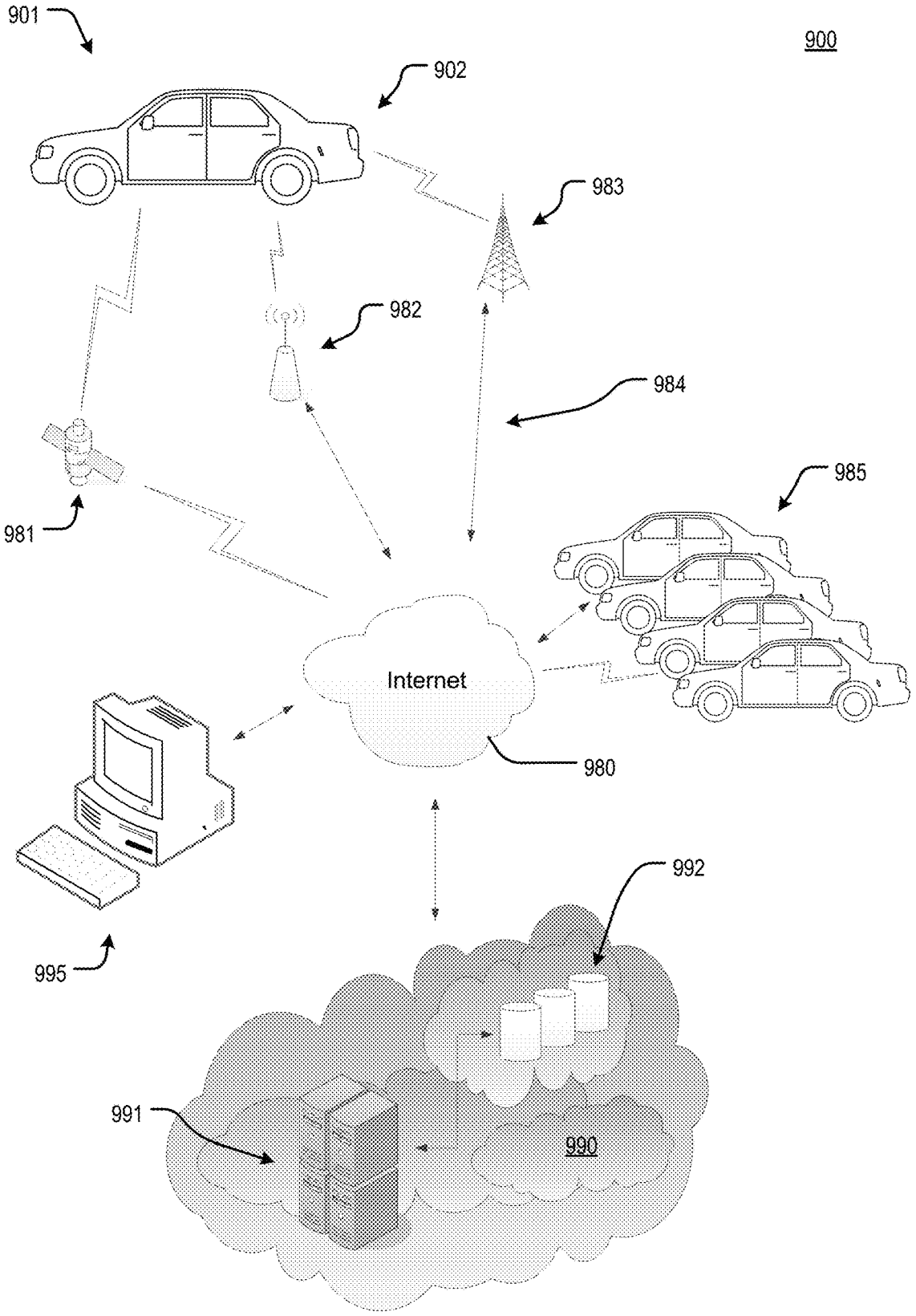
FIG. 9 is a schematic illustrating the communication architecture of a global system for a cloud-driven traffic management system, according to an exemplary embodiment of the present disclosure.

FIG. 9 illustrates an exemplary Internet-based, cloud-driven traffic management system (TMS), wherein a floating vehicle or a fleet of floating vehicles are connected to a cloud-computing environment via waypoints that are connected to the Internet. It will be noted that certain aspects of the following description have been described individually in previous Figures.

According to an embodiment, a floating vehicle 901 having an electronics control unit (ECU) 902 can connect to the Internet 980 via a wireless communication hub, through a wireless communication channel such as a base station 983 (e.g., an Edge, 3G, 4G, or LTE Network), an access point 982 (e.g., a femto cell or Wi-Fi network), or a satellite connection 981. Merely representative, each floating vehicle of a fleet of floating vehicles 920 may similarly connect to the Internet 980 in order to access and communicate with the TMS 800. In an example, longitudinal sensor data from a plurality of sensors of the floating vehicle 901 can be stored in a data storage center 992 of a cloud-computing environment 990. Moreover, the data storage center 992 can provide storage of external data or access to external data sources.

A server 991 can permit uploading, storing, processing, and transmitting of sensor data, and related instructions, from the data storage center 992. In an example, data from at least one of the plurality of sensors of the vehicle may be received and processed by the server 991, via ECU of the vehicle, in order to update infrastructure in real-time. The server 991 can be a computer cluster, a data center, a main frame computer, or a server farm. In one implementation, the server 991 and data storage center 993 are collocated.

Infrastructure updates, introduce above, can be performed by the server 991 of the cloud-computing environment 990 and/or can be performed by a human user at a terminal 995. The terminal can be a desktop workstation, laptop, or mobile device equipped to access and control infrastructure via the Internet 980. In an example, the terminal 995 can be located within a local, state, or federal government office and be securely controlled by the appropriate authorities. The terminal 995 can provide for monitoring of performance of the server 991 and the traffic management system, writ large, as well as affording a user the ability to override the server 991, when needed, or provide off-script instructions to the server 991.

According to an embodiment, the floating vehicle 901 may connect to the server 991 via TCP/IP and the Internet 980. The floating vehicle 901 may authenticate toward the server 991 with a unique vehicle identifier and/or MAC address of the connectivity device. The authentication mechanism can be performed via known techniques including but not limited to SSL. The floating vehicle 901, accordingly, can be assigned and registered to a specific user account. In an example, the specific user account can be associated with a mobile device, and GNSS coordinates can be provided thereby.

In an embodiment, raw and/or processed data from at least one of the plurality of sensors of the floating vehicle 901 can be transmitted to the cloud-computing environment 990 for processing by the server 991 and/or storage in the data storage center 993.

Figure 10:
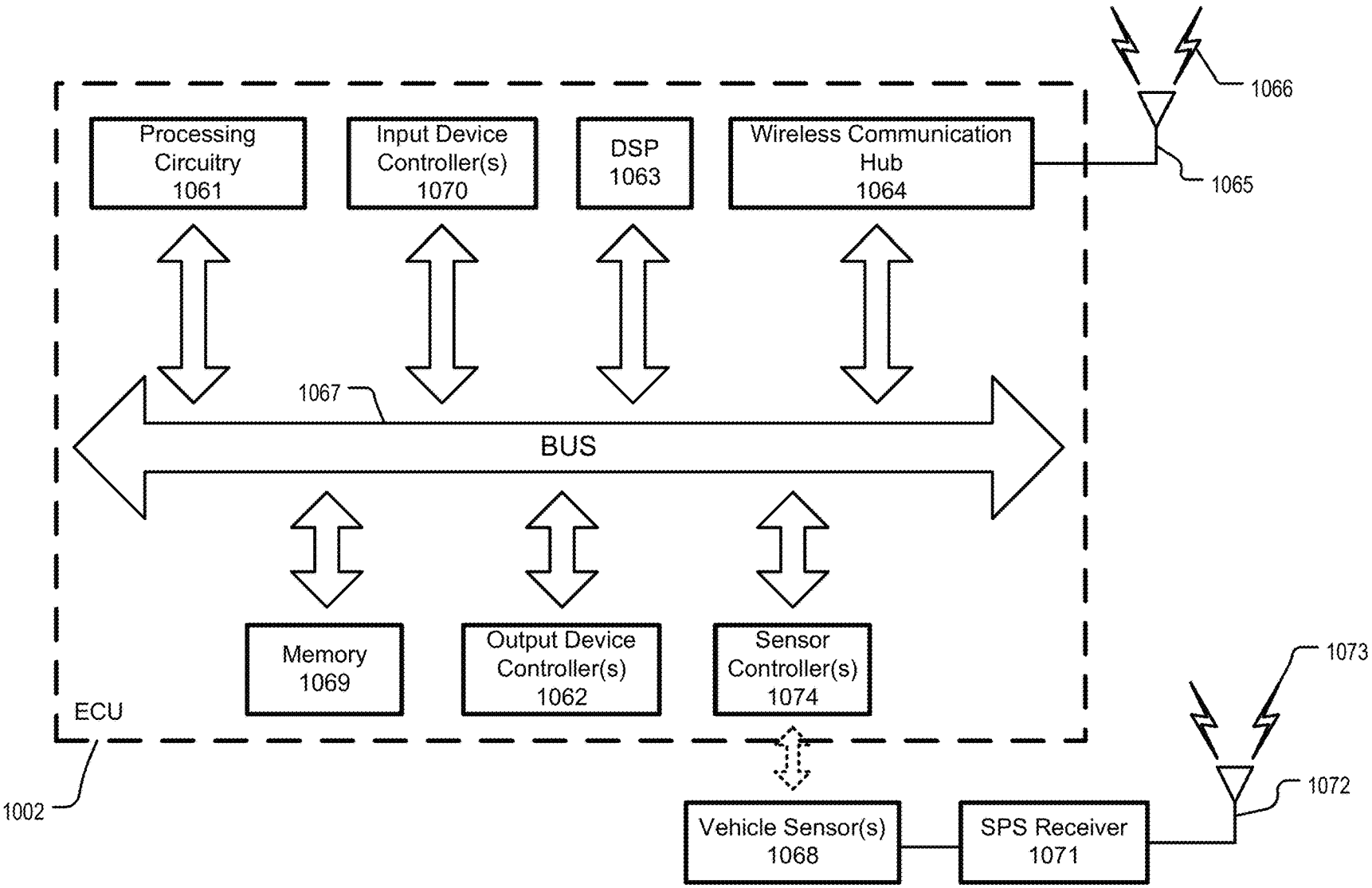
FIG. 10 is a block diagram of an electronics control unit of a floating vehicle, according to an exemplary embodiment of the present disclosure.

FIG. 10 is a block diagram of internal components of an exemplary embodiment of an electronics control unit (ECU) that may be implemented. For instance, the ECU 1002 may represent an implementation of a telematics and GPS ECU or a video ECU. It should be noted that FIG. 10 is meant only to provide a generalized illustration of various components, any or all of which may be utilized as appropriate. It can be noted that, in some instances, components illustrated by FIG. 10 can be localized to a single physical device and/or distributed among various networked devices, which may be disposed at different physical locations within a floating vehicle.

The ECU 1002 is shown comprising hardware elements that can be electrically coupled via a BUS 1067 (or may otherwise be in communication, as appropriate). The hardware elements may include processing circuitry 1061 which can include without limitation one or more processors, one or more special-purpose processors (such as digital signal processing (DSP) chips, graphics acceleration processors, application specific integrated circuits (ASICs), and/or the like), and/or other processing structure or means. The above-described processors can be specially-programmed to perform operations including, among others, image processing and data processing. Some embodiments may have a separate DSP 1063, depending on desired functionality. The ECU 1002 also can include one or more input device controllers 1070, which can control without limitation an in-vehicle touch screen, a touch pad, microphone, button(s), dial(s), switch(es), and/or the like. In an embodiment, a mobile device as described above can be implemented within an 'in-vehicle touch screen'.

According to an embodiment, the ECU 1002 can also include one or more output device controllers 1062, which can control without limitation a display, light emitting diode (LED), speakers, and/or the like.

The ECU 1002 may also include a wireless communication hub 1064, or connectivity hub, which can include without limitation a modem, a network card, an infrared communication device, a wireless communication device, and/or a chipset (such as a Bluetooth device, an IEEE 802.11 device, an IEEE 802.16.4 device, a WiFi device, a WiMax device, cellular communication facilities including 4G, 5G, etc.), and/or the like. The wireless communication hub 1064 may permit data to be exchanged with, as described, in part, with reference to FIG. 9, a network, wireless access points, other computer systems, and/or any other electronic devices described herein. The communication can be carried out via one or more wireless communication antenna(s) 1065 that send and/or receive wireless signals 1066.

Depending on desired functionality, the wireless communication hub 1064 can include separate transceivers to communicate with base transceiver stations (e.g., base stations of a cellular network) and/or access point(s). These different data networks can include various network types. Additionally, a Wireless Wide Area Network (WWAN) may be a Code Division Multiple Access (CDMA) network, a Time Division Multiple Access (TDMA) network, a Frequency Division Multiple Access (FDMA) network, an Orthogonal Frequency Division Multiple Access (OFDMA) network, a WiMax (IEEE 802.16), and so on. A CDMA network may implement one or more radio access technologies (RATs) such as cdma2000, Wideband-CDMA (W-CDMA), and so on. Cdma2000 includes IS-95, IS-2000, and/or IS-856 standards. A TDMA network may implement Global System for Mobile Communications (GSM), Digital Advanced Mobile Phone System (D-AMPS), or some other RAT. An OFDMA network may employ LTE, LTE Advanced, and so on, including 4G and 5G technologies.

The ECU 1002 can further include sensor controller(s) 1074. Such controllers can control, without limitation, the plurality of sensors 1068 of the floating vehicle, including, among others, one or more accelerometer(s), gyroscope(s), camera(s), radar(s), LiDAR(s), odometric sensor(s), and ultrasonic sensor(s), as well as magnetometer(s), altimeter (s), microphone(s), proximity sensor(s), light sensor(s), and other vehicle instruments and the like.

Embodiments of the ECU 1002 may also include a Satellite Positioning System (SPS) receiver 1071 capable of receiving signals 1073 from one or more SPS satellites using an SPS antenna 1072. The SPS receiver 1071 can extract a position of the floating vehicle, using conventional techniques, from satellites of an SPS system, such as a global navigation satellite system (GNSS) (e.g., Global Positioning System (GPS)), Galileo, Glonass, Compass, Quasi-Zenith Satellite System (QZSS) over Japan, Indian Regional Navigational Satellite System (IRNSS) over India, Beidou over China, and/or the like. Moreover, the SPS receiver 1071 can be used by various augmentation systems (e.g., an Satellite Based Augmentation System (SBAS)) that may be associated with or otherwise enabled for use with one or more global and/or regional navigation satellite systems. By way of example but not limitation, an SBAS may include an augmentation system(s) that provides integrity information, differential corrections, etc., such as, e.g., Wide Area Augmentation System (WAAS), European Geostationary Navigation Overlay Service (EGNOS), Multi-functional Satellite Augmentation System (MSAS), GPS Aided Geo Augmented Navigation or GPS and Geo Augmented Navigation system (GAGAN), and/or the like. Thus, as used herein an SPS may include any combination of one or more global and/or regional navigation satellite systems and/or augmentation systems, and SPS signals may include SPS, SPS-like, and/or other signals associated with such one or more SPS.

The ECU 1002 may further include and/or be in communication with a memory 1069. The memory 1069 can include, without limitation, local and/or network accessible storage, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

The memory 1069 of the ECU 1002 also can comprise software elements (not shown), including an operating system, device drivers, executable libraries, and/or other code embedded in a computer-readable medium, such as one or more application programs, which may comprise computer programs provided by various embodiments, and/or may be designed to implement methods, and/or configure systems, provided by other embodiments, as described herein. In an aspect, then, such code and/or instructions can be used to configure and/or adapt a general purpose computer (or other device) to perform one or more operations in accordance with the described methods, thereby resulting in a special-purpose computer.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

Obviously, numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A server, comprising:

processing circuitry configured to receive sensor data from a plurality of sensors of a probe vehicle within a traffic stream, determine, based at least on the received sensor data, an average traffic speed along a current road segment, the average traffic speed determined at least by calculating a speed of neighboring vehicles adjacent to a travelling lane of the probe vehicle, wherein the neighboring vehicles are successive, adjacent vehicles travelling on adjacent lanes of the travelling lane of the probe vehicle, determine, based at least on the received sensor data, an average traffic density along the current road segment, the average traffic density determined at least by calculating distances between the probe vehicle and the neighboring vehicles adjacent thereto, transmit, based at least on a comparison of the determined average traffic speed and the determined average traffic density to a threshold, an update to infrastructure in order to modify a condition of the traffic stream in real-time, and control a condition of the traffic stream of the current road segment in response to the update to the infrastructure.

2. The server according to claim 1, wherein the plurality of sensors of the probe vehicle includes sensors selected from a group including radar and lidar.

3. The server according to claim 1, wherein, when one of the neighboring vehicles adjacent to the probe vehicle overtakes or is overtaken by the probe vehicle, the processing circuitry is further configured to calculate a speed of the one of the neighboring vehicles adjacent to the probe vehicle based at least upon a distance between a subset of the plurality of sensors arranged along a side of the probe vehicle, a speed of the probe vehicle, and time stamps at which each of the subset of the plurality of sensors is activated or deactivated.

4. The server according to claim 3, wherein the speed of the one of the neighboring vehicles adjacent to the probe vehicle overtaking or being over taken by the probe vehicle is calculated as $$V_A = V_X + \frac{2d}{(FR - BR) + (FF - BF)},$$

where $V_A$ is the speed of the one of the neighboring vehicles, $V_X$ is the speed of the probe vehicle, d is the distance between the subset of the plurality of sensors, FR and BR define the time stamps associated with activation of each of the subset of the plurality of sensors, and FF and BF define the time stamps associated with deactivation of each of the subset of the plurality of sensors.

5. The server according to claim 1, wherein the processing circuitry is further configured to calculate a distance of the distances between the probe vehicle and the neighboring vehicles adjacent thereto as $$Gap_n = \frac{(FR_{n+1} - FR_n) + (BR_{n+1} - BR_n)}{2} * \left[\frac{(V_n + V_{n+1})}{2} - V_X\right],$$

where $Gap_n$ is a distance between successive, adjacent vehicles of an adjacent lane, $V_n$ and $V_{n+1}$ are speeds of successive, adjacent vehicles overtaking or being overtaken by the probe vehicle, $V_X$ is a speed of the probe vehicle, and $FR_n$, $FR_{n+1}$, $BR_n$, and $BR_{n+1}$ define time stamps associated with activation of each of a subset of the plurality of sensors, a series of the time stamps being acquired for each of the successive, adjacent vehicles.

6. The server according to claim 5, wherein the determined average traffic density is calculated as $$D_{avg} = \frac{1}{3}\left\{\frac{1}{\overline{Gap}_{Left}} + \frac{2}{\overline{R}_{Front} + \overline{R}_{Back}} + \frac{1}{+\overline{Gap}_{Right}}\right\},$$

where $D_{avg}$ is the average traffic density for the current road segment, $\overline{Gap}_{Left}$ is an average of calculated distances between successive, adjacent vehicles on a left side of the probe vehicle for the current road segment, $\overline{Gap}_{Right}$ is an average of calculated distances between successive, adjacent vehicles on a right side of the probe vehicle for the current road segment, $\overline{R}_{Back}$ is an average distance between a trailing vehicle and the probe vehicle, and $\overline{R}_{Front}$ is an average distance between a leading vehicle and the probe vehicle.

7. The server according to claim 1, wherein the update to the infrastructure includes adjusting a displayed speed limit for the current road segment.

8. The server according to claim 7, wherein the adjustment to the displayed speed limit for the current road segment is based at least upon a determined level of service for the current road segment.

9. A method, comprising:

receiving, by processing circuitry, sensor data from a plurality of sensors of a probe vehicle within a traffic stream;

determining, by the processing circuitry and based at least on the received sensor data, an average traffic speed along a current road segment, the average traffic speed determined at least by calculating a speed of neighboring vehicles adjacent to a travelling lane of the probe vehicle, wherein the neighboring vehicles are successive, adjacent vehicles travelling on adjacent lanes of the travelling lane of the probe vehicle;

determining, by the processing circuitry and based at least on the received sensor data, an average traffic density along the current road segment, the average traffic density determined at least by calculating distances between the probe vehicle and the neighboring vehicles adjacent thereto;

transmitting, by the processing circuitry and based at least on a comparison of the determined average traffic speed and the determined average traffic density to a threshold, an update to infrastructure in order modify a condition of the traffic stream in real-time, and controlling a condition of the traffic stream of the current road segment in response to the update to the infrastructure.

10. The method according to claim 9, wherein the plurality of sensors of the probe vehicle includes sensors selected from a group including radar and lidar.

11. The method according to claim 9, further comprising, when one of the neighboring vehicles adjacent to the probe vehicle overtakes or is overtaken by the probe vehicle, calculating, by the processing circuitry, a speed of the one of the neighboring vehicles adjacent to the probe vehicle based at least upon a distance between a subset of the plurality of sensors arranged along a side of the probe vehicle, a speed of the probe vehicle, and time stamps at which each of the subset of the plurality of sensors is activated or deactivated.

12. The method according to claim 11, wherein the speed of the one of the neighboring vehicles adjacent to the probe vehicle overtaking or being over taken by the probe vehicle is calculated as $$V_A = V_X + \frac{2d}{(FR - BR) + (FF - BF)},$$

where $V_A$ is the speed of the one of the neighboring vehicles, $V_X$ is the speed of the probe vehicle, d is the distance between the subset of the plurality of sensors, FR and BR define the time stamps associated with activation of each of the subset of the plurality of sensors, and FF and BF define the time stamps associated with deactivation of each of the subset of the plurality of sensors.

13. The method according to claim 9, further comprising calculating, by the processing circuitry, a distance of the distances between the probe vehicle and the neighboring vehicles adjacent thereto as $$Gap_n = \frac{(FR_{n+1} - FR_n) + (BR_{n+1} - BR_n)}{2} * \left[\frac{(V_n + V_{n+1})}{2} - V_X\right],$$

where $Gap_n$ is a distance between successive, adjacent vehicles of an adjacent lane, $V_n$ and $V_{n+1}$ are speeds of successive, adjacent vehicles overtaking or being overtaken by the probe vehicle, $V_X$ is a speed of the probe vehicle, and $FR_n$, $FR_{n+1}$, $BR_n$, and $BR_{n+1}$ define time stamps associated with activation of each of a subset of the plurality of sensors, a series of the time stamps being acquired for each of the successive, adjacent vehicles.

14. The method according to claim 13, wherein the determined average traffic density is calculated as $$D_{avg} = \frac{1}{3}\left\{\frac{1}{\overline{Gap}_{Left}} + \frac{2}{\overline{R}_{Front} + \overline{R}_{Back}} + \frac{1}{+\overline{Gap}_{Right}}\right\},$$

where $D_{avg}$ is the average traffic density for the current road segment, $\overline{Gap}_{Left}$ is an average of calculated distances between successive, adjacent vehicles on a left side of the probe vehicle for the current road segment, $\overline{Gap}_{Right}$ is an average of calculated distances between successive, adjacent vehicles on a right side of the probe vehicle for the current road segment, $\overline{R}_{Back}$ is an average distance between a trailing vehicle and the probe vehicle, and $\overline{R}_{Front}$ is an average distance between a leading vehicle and the probe vehicle.

15. The method according to claim 9, wherein the update to the infrastructure includes adjusting a displayed speed limit for the current road segment.

16. The method according to claim 15, wherein an adjustment to the displayed speed limit for the current road segment is based at least upon a determined level of service for the current road segment.

17. A non-transitory computer-readable storage medium storing computer-readable instructions that, when executed by a computer, cause the computer to perform a method of a server, comprising:

receiving sensor data from a plurality of sensors of a probe vehicle within a traffic stream;

determining, based at least on the received sensor data, an average traffic speed along a current road segment, the average traffic speed determined at least by calculating a speed of neighboring vehicles adjacent to a travelling lane of the probe vehicle, wherein the neighboring vehicles are successive, adjacent vehicles travelling on adjacent lanes of the travelling lane of the probe vehicle;

determining, based at least on the received sensor data, an average traffic density along the current road segment, the average traffic density determined at least by calculating distances between the probe vehicle and the neighboring vehicles adjacent thereto;

transmitting, based at least on a comparison of the determined average traffic speed and the determined average traffic density to a threshold, an update to infrastructure in order modify a condition of the traffic stream in real-time, and controlling a condition of the traffic stream of the current road segment in response to the update to the infrastructure.

18. The non-transitory computer-readable storage medium according to claim 17, wherein a speed of one of the neighboring vehicles adjacent to the probe vehicle overtaking or being over taken by the probe vehicle is calculated as $$V_A = V_X + \frac{2d}{(FR - BR) + (FF - BF)},$$

where $V_A$ is the speed of the one of the neighboring vehicles, $V_X$ is a speed of the probe vehicle, d is a distance between a subset of the plurality of sensors arranged along a side of the probe vehicle, FR and BR define time stamps associated with activation of each of the subset of the plurality of sensors, and FF and BF define time stamps associated with deactivation of each of the subset of the plurality of sensors.

19. The non-transitory computer-readable storage medium according to claim 18, wherein the determined average traffic density is calculated as $$D_{avg} = \frac{1}{3}\left\{\frac{1}{\overline{Gap}_{Left}} + \frac{2}{\overline{R}_{Front} + \overline{R}_{Back}} + \frac{1}{+\overline{Gap}_{Right}}\right\},$$

where $D_{avg}$ is the average traffic density for the current road segment, $\overline{Gap}_{Left}$ is an average of calculated distances between successive, adjacent vehicles on a left side of the probe vehicle for the current road segment, $\overline{Gap}_{Right}$ is an average of calculated distances between successive, adjacent vehicles on a right side of the probe vehicle for the current road segment, $\overline{R}_{Back}$ is an average distance between a trailing vehicle and the probe vehicle, and $\overline{R}_{Front}$ is an average distance between a leading vehicle and the probe vehicle.

20. The non-transitory computer-readable storage medium according to claim 17, wherein the update to the infrastructure includes adjusting a displayed speed limit for the current road segment.

* * * * *